US011896069B1

(12) United States Patent
Boord

(10) Patent No.: US 11,896,069 B1
(45) Date of Patent: Feb. 13, 2024

(54) DISC GOLF JACKET

(71) Applicant: James Boord, Post Falls, ID (US)

(72) Inventor: James Boord, Post Falls, ID (US)

( * ) Notice: Subject to any disclaimer, the term of this patent is extended or adjusted under 35 U.S.C. 154(b) by 0 days.

(21) Appl. No.: 18/125,242

(22) Filed: Mar. 23, 2023

(51) Int. Cl.

| | |
|---|---|
| ***A41D 27/20*** | (2006.01) |
| ***A41D 1/02*** | (2006.01) |
| ***A63B 71/00*** | (2006.01) |
| *A63B 65/10* | (2006.01) |

(52) U.S. Cl.
CPC ..... *A41D 27/20* (2013.01); *A41D 1/02* (2013.01); *A63B 71/0036* (2013.01); *A63B 65/10* (2013.01)

(58) Field of Classification Search
CPC ..... A41D 27/20; A41D 1/02; A41D 27/202
See application file for complete search history.

(56) References Cited

U.S. PATENT DOCUMENTS 1,426,024 A * 8/1922 Thureson ..... A41D 13/0012 224/645
2,272,041 A * 2/1942 Pocock ..... A41D 13/0012 2/94
2,320,783 A * 6/1943 Lee ..... A41D 15/002 2/94
2,437,223 A * 3/1948 Dutrow ..... A41D 13/01 D2/839
2,448,449 A * 8/1948 Masland ..... A41D 13/0012 D2/836
2,620,479 A * 12/1952 Buck ..... A41D 13/0012 2/102
2,755,480 A * 7/1956 Jones ..... A41D 13/0012 2/94
4,156,295 A * 5/1979 LeRoy ..... A41D 27/20 2/252
4,669,127 A * 6/1987 Swanson ..... A41D 13/0012 2/46
4,689,831 A * 9/1987 Greenberger ..... A45F 4/12 2/93
5,014,359 A * 5/1991 Hanson ..... A45F 4/12 2/102
5,142,702 A * 9/1992 Piloian ..... A41D 13/1245 2/102
5,195,187 A * 3/1993 Yang ..... A41D 13/0012 2/108
5,718,000 A 2/1998 Ost et al.
5,803,333 A * 9/1998 Fawcett ..... A45F 3/00 224/655
D399,637 S * 10/1998 Suding ..... D2/839
(Continued)

*Primary Examiner* — Alissa L Hoey
(74) *Attorney, Agent, or Firm* — Dale J. Ream

(57) ABSTRACT

A disc golf jacket includes a front torso portion that covers a front torso of a player. The jacket includes a back portion that is coupled to the front torso portion along a top edge. The jacket includes an upper pocket having opposed side edges and a bottom edge therebetween which, together, are coupled to the back portion for defining an upper pocket interior area. The upper pocket includes an open top edge for receiving a disc in a top-loaded configuration. The jacket includes a lower pocket having a lower edge coupled to the back portion, left and right-side edges coupled to the lower edge, the side edges extending at angles that converge toward one another until meeting at an upper edge. The side edges are open for receiving a second disc in a side-loaded manner.

7 Claims, 5 Drawing Sheets

(56) References Cited

U.S. PATENT DOCUMENTS 5,991,925 A * 11/1999 Wu ..... A41D 13/0012 224/931
D426,937 S * 6/2000 Auster ..... D2/839
6,154,888 A * 12/2000 Krohn ..... A41D 27/20 2/250
6,626,733 B1 * 9/2003 Knutson ..... A41D 13/0012 224/148.1
7,000,255 B1 * 2/2006 Baacke ..... A41D 13/0012 2/94
7,490,361 B1 * 2/2009 Floyd ..... A63B 21/4005 2/94
7,886,368 B2 * 2/2011 Hood ..... A41D 1/04 2/102
D674,578 S * 1/2013 Glass ..... D2/731
D686,410 S * 7/2013 Belline ..... D3/221
8,678,259 B2 * 3/2014 Hurst ..... A45F 5/00 224/661
8,756,717 B2 * 6/2014 Claeys ..... A41D 27/20 2/250
9,271,533 B2 * 3/2016 Kochling ..... A41D 27/205
9,375,037 B1 * 6/2016 Clark ..... A47D 13/00
D767,255 S * 9/2016 Marino ..... D2/750
9,456,639 B2 * 10/2016 Aylward ..... A41D 27/205
10,687,563 B2 6/2020 Plant et al.
10,694,790 B2 * 6/2020 Blackwood ..... A41D 1/04
10,757,992 B2 9/2020 Studinger
10,791,774 B2 * 10/2020 Plant ..... A41D 27/201
10,842,203 B2 11/2020 Wood et al.
10,918,148 B2 * 2/2021 Brandt ..... A41D 1/02
11,006,677 B2 * 5/2021 Jones ..... A41D 27/20
11,026,457 B1 * 6/2021 Mayer ..... A41D 27/201
11,140,931 B1 10/2021 Stewart
11,266,185 B2 * 3/2022 Plant ..... A41D 1/005
11,395,520 B2 * 7/2022 Plant ..... A41D 1/04
11,452,323 B2 * 9/2022 Hourani ..... A41D 27/201
11,457,678 B2 * 10/2022 Hironaka ..... A41D 3/08
11,627,765 B2 * 4/2023 Plant ..... A41D 3/005 2/253
2002/0040493 A1 * 4/2002 Wooley ..... A41D 13/0012 2/102
2011/0062203 A1 * 3/2011 Weger ..... A45F 5/02 224/191
2016/0270460 A1 * 9/2016 Rabinowitz ..... A41D 3/04
2020/0054083 A1 * 2/2020 Park ..... A41D 15/04
2021/0137181 A1 * 5/2021 Patel ..... A41D 31/145
2021/0329985 A1 * 10/2021 Arizmendi ..... A41D 27/20

* cited by examiner

DISC GOLF JACKET

BACKGROUND OF THE INVENTION

This invention relates generally to gamer jackets and, more particularly, to a jacket having first and second pockets positioned on a rear portion of the jacket that are configured for holding discs commonly used in the game of disc golf, respectively.

Disc golf is a game that is played extensively similarly to the game of traditional golf but with disc golf discs rather than with balls and clubs and by throwing the disc golf discs into respective baskets rather than putting golf balls into holes. The goal is to play each hole in the fewest strokes, i.e., throws, possible. One throw equals one stroke. The low was total strokes for the entire course was deemed the winner. Each hole is completed will the disc comes to rest and the disc basket, respectively.

Traditionally, a disc golf player may use the same disc golf disc throughout the entire game unless the disc becomes lost or unusable due to breakage. However, a player may carry discs of different size for use in various circumstances. There may be times, however, when the game may be suspended, such as during a rain event, or if a player is otherwise called away or unable to finish the game. In that circumstance, the player may desire to stow the disc rather than to carry it. A desire to store the disc would also be desirable when walking, driving, or riding a bicycle to or from a disk golf course.

Although various jackets, coats, sweatshirts, and hoodies have been proposed in the art for carrying traditional electronic gaming devices, waterfowl, or hunting gear, these devices are not optimally suitable for carrying disc golf disc and definitely not for carrying such discs in a manner in which it can be pulled over the head of the user or around the back of the user.

Therefore, it would be desirable to have a disc golf jacket that includes a first pocket positioned on a backside of the jacket and having an opening so that a disc golf disc may be pulled over the shoulder and head of a user when needed. Further, it would be desirable to have a disc golf jacket that includes a second pocket positioned on a backside of the jacket below the first pocket and that has an opening so that a disc golf disc may be extracted around a lateral side of the user when desired.

SUMMARY OF THE INVENTION

This invention is directed to a disc golf jacket according to the present invention that includes a front torso portion extending upwardly between a front waist section and a neck section that is configured to cover the front torso of the player. The disc golf jacket may include a back portion extending upwardly from a rear waist section to the neck section, the back portion being coupled to the front torso portion along a top edge extending laterally away from the neck section. In another aspect, the disc golf jacket may include an upper pocket having at least a first side edge, a second side edge opposite the first side edge, and a bottom edge extending between the first and second side edges and which, together, are coupled to the back portion via stitching so as to define an upper pocket interior area having a closed bottom. The upper pocket includes a top edge extending between upper ends of the first and second side edges, respectively, that is open and in communication with the upper pocket interior area and such that the upper pocket is configured to receive a disc golf disc in a top-loaded configuration via the top edge. Further, the disc golf jacket may include a lower pocket including at least a lower edge coupled to the back portion, a left side edge having a proximal end coupled to a first end of the lower edge, and a right-side edge having a proximal end coupled to a second end of the lower edge, the left side edge and the right-side edge extending away from the lower edge at angles that converge upwardly toward one another until meeting one another at an upper edge. The left side edge and the right-side edge being open and unconnected to the back portion such that the lower pocket defines a lower pocket interior area that is configured to receive a second disc golf disc in a side-loaded manner via the left side edge or the right-side edge.

Therefore, a general object of this invention is to provide a disc golf jacket having upper and lower pockets situated on a rear portion that enable a player to store and then extract disc golf discs for gameplay.

Another object of this invention is to provide a disc golf jacket, as aforesaid, having an upper pocket from which a disc golf disc may be withdrawn in an over the shoulder or over the head motion.

Still another object of this invention is to provide a disc golf jacket, as aforesaid, having a lower pocket from which a disc golf disc may be withdrawn in a side mount motion.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
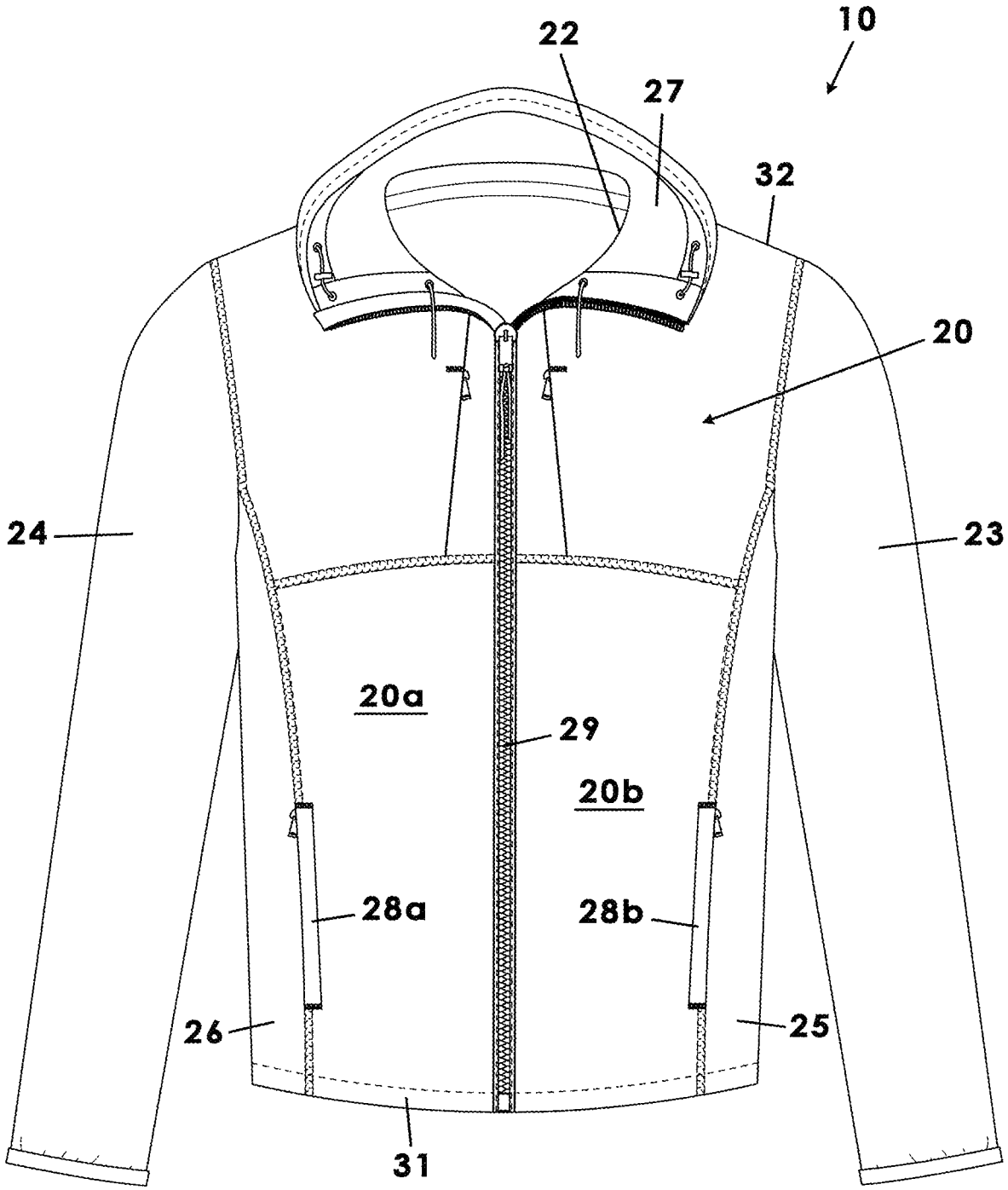
FIG. 1 is a front view of a disk golf jacket according to a preferred embodiment of the present invention.
Figure 2:
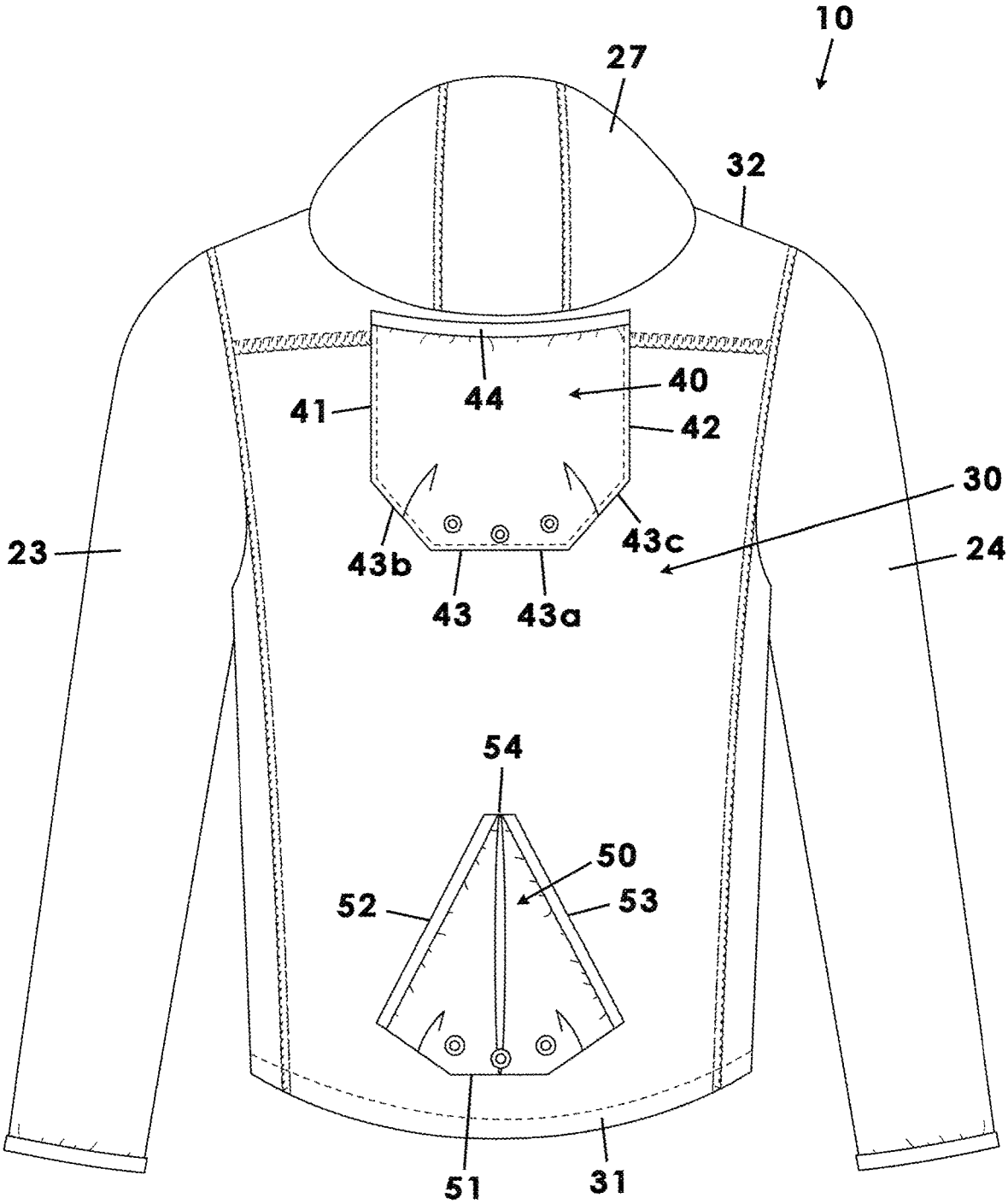
FIG. 2 is a rear view of the disc golf jacket as in FIG. 1.

A disc golf jacket according to a preferred embodiment of the present invention will now be described with reference to FIG. 1 to FIG. 5 of the accompanying drawings. The disc golf jacket 10 includes a front torso portion 20 and a back portion 30 having an upper pocket and a lower pocket 50 configured for disk storage and deployment.

The front torso portion 20 of the disc golf jacket 10 includes a front waist section 21 as the lower edge or lower boundary of the jacket 10. Opposite the front waist section 21 is a neck section 22, i.e., an open neck ring. The front torso portion 20, therefore, is a solid panel of a textile material, such as cotton, wool, or synthetic fibers such as polyester so as to be flexible during gameplay. The front torso portion 20 extends between the front waist section 21 and neck section 22.

The disc golf jacket 10 also includes a back portion 30 that includes a solid panel constructed of a textile material extending between a rear waist section 31 at a lowest edge to the neck section 22 described above. Preferably, the front waist section 21 is integrated in construction with the rear waist section 31. The back portion 30 is connected to the front torso portion 20 along a top edge 32 that essentially extends away from laterally opposite sides of the neck section 22. For instance, the front torso portion 20 may have a unitary construction with the back portion 30 although being coupled together with stitching would also work. In addition, the front and rear portions, together, define an interior space for receiving the body of a wearer—in this case a disc golf player. The front torso portion 20 and back portion 30 are configured for covering the torso and back of the disc golf player.

Further, a left sleeve 23 and a right sleeve 24 may be coupled to the front torso portion 20 adjacent the neck section 21, i.e., attached near the top of the jacket 10, each sleeve 23, 24 being configured for covering the arms of the wearer and each defining an internal space being in communication with the interior space defined between the front torso portion 20 and back portion 30. Further, the disc golf jacket 10 includes a left side portion 25 and a right side portion 26 laterally connecting the front torso portion 20 to the back portion More particularly, the left side portion 25 extends upwardly between the waist sections of the front and back portions 20, 30 to just under the left sleeve 23. Likewise, the right-side portion 26 extends upwardly between the waist sections of the front and back portions 20, 30 to just under the right sleeve 24.

In addition, a collar 27 may be coupled to the front torso portion 20 and back portion and positioned to surround the neck section 22 so as to protect the neck of a disc golf player from a weather event such as wind or rain.

As described so far, the front torso portion 20 and back portion 30 describes a sweatshirt or hoodie. Preferably, however, the present invention is a disc golf jacket 10; therefore, the front torso portion 20 may include a zipper 29 extending between the front waist section 21 and the neck section 22 and centrally positioned so as to divide the front torso portion 20 into left and right sections 20*a*, 20*b*. The zipper 29 is operable for movement between open and closed configurations in a traditional operation of a jacket or coat.

Figure 4:
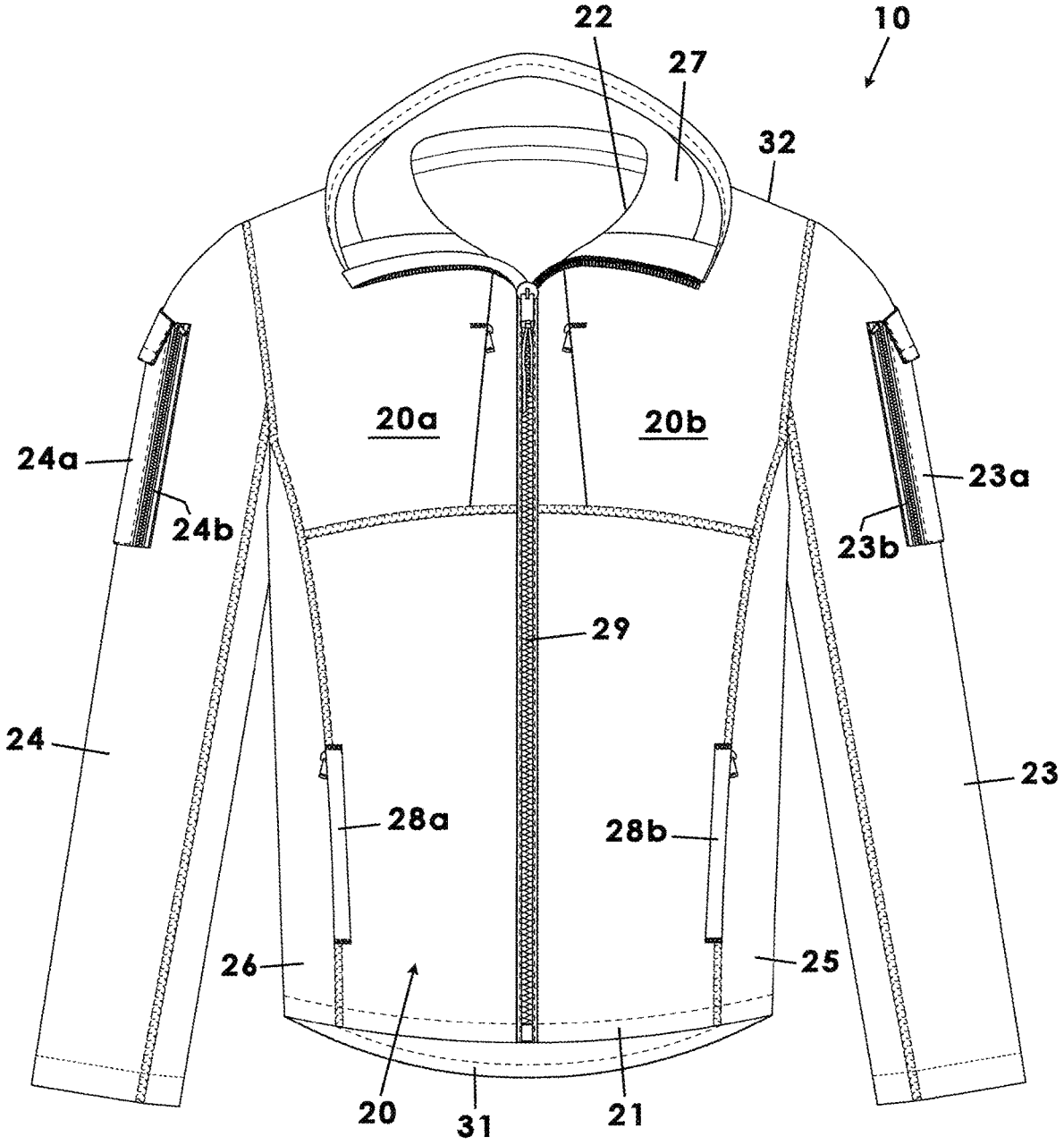
FIG. 4 is a front view of a disc golf jacket according to the present invention illustrated with an optional pair of sleep pockets.

In an embodiment, each sleeve may include a pocket referred to as a sleeve pocket 23*a*, 24*a* (FIG. 4). Each sleeve pocket may include sleeve pocket chamber capable of receiving articles belonging to the wearer, such as car/house keys, money, or the like. Further, each sleeve pocket 23*a*, 24*a* may include a closure fastener, such as a sleeve zipper 23*b*, 24*b* that is movable in a traditional slidable manner between an open configuration allowing access into the sleeve pocket chamber and a closed configuration blocking access to the sleeve pocket chamber, respectively.

Similarly, the front torso portion 20 may include a pair of front pockets 28*a*, 28*b*— one positioned on each of the left and right sections. The pair of front pockets may have a traditional construction defining chambers capable of holding articles and may or may not include closure fasteners.

In a critical aspect, the back portion 30 of the disc golf jacket 10 may include at least one and, preferably, a pair of pockets configured to optimize a wearer's experience in playing a round of a disc golf game. First, an upper pocket 40 is positioned on the back portion 30 just below the neck section 22 and is oriented in a top-loaded configuration such that a first disc golf disc 12 may be extracted upwardly over a player's head or shoulder in a manner similar to pulling and arrow from a quiver while hunting or otherwise participating in archery. Second, a lower pocket 50 is positioned on the back portion 30 intermediate the upper pocket 40 and the rear waist section 31 and is oriented in a side-loaded configuration such that a second golf disc 14 may be extracted laterally, i.e., from the side of the wearer.

Figure 3:
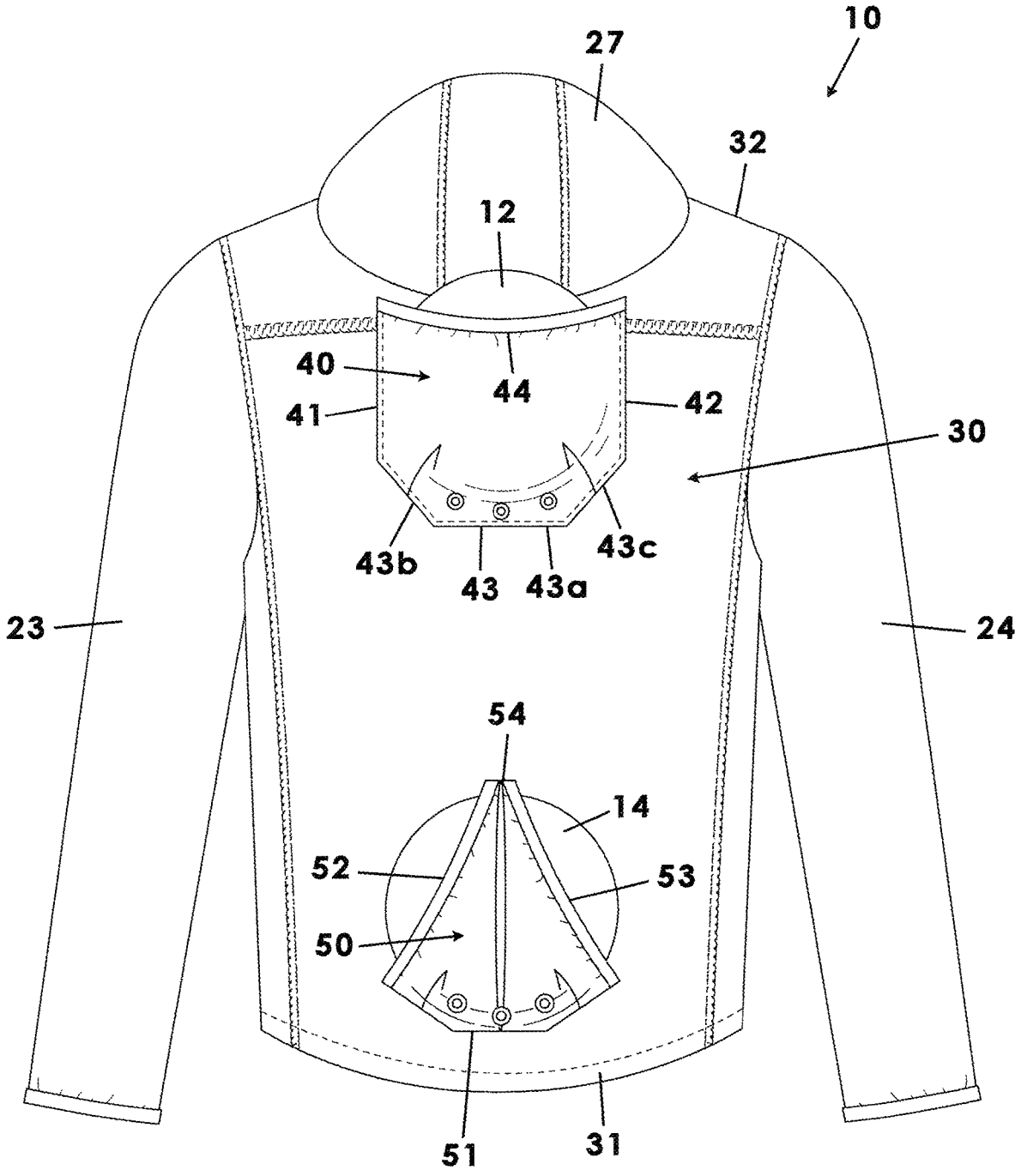
FIG. 3 is another rear view of the disc golf jacket as in FIG. 2, illustrated with first and second gaming discs being lodged in first and second pocket chambers, respectively.

Described now in greater detail and with reference to FIG. 3, the upper pocket 40 may include a first side edge 41 and a second side edge 42 that is opposite and parallel to the first side edge 41, the upper pocket 40 having a bottom edge 43 extending between the first and second side edges 41, 42. The bottom edge 43, first edge 41, and second side edge 42 are all closed and coupled to the back portion 30 such as with stitching or other fasteners so as to together define an upper pocket interior area that is closed on three sides. A flexible textile panel extends between the edges.

Further, the upper pocket 40 may include a top edge 44 that is generally opposite the bottom edge 43 and which extends between upper ends of the first side edge 41 and second side edge 42 the top edge 44 being opened and not coupled to the back portion 30. It is understood that the open top edge 44 is in communication with the upper pocket interior area and configured to receive the first disc golf disc 12. It is understood that the that is open is positioned nearest the neck section 22 of the disc golf jacket 10 such that the wearer of the disc golf jacket 10 is able to reach an arm over his shoulder and extract the first disc golf disc 12 from the upper pocket 40 in the manner of extracting an arrow from a quiver.

With further specific detail relative to FIG. 3, the lower pocket 50 may include a lower edge 51 coupled to the back portion 30, such as with stitching. Further, the lower pocket 50 may include a left side edge 52 having a proximal and coupled to a first end of the lower edge 51 and a right-side edge 53 having a proximal end coupled to a second end of the lower edge 51, the first and second ends of the lower edge 51 being opposite one another. Further still, the left side edge 52 and right-side edge 53 extend upwardly away from the lower edge 41 at upwardly and inwardly converging angles toward one another and, in fact, substantially converging or meeting one another at an upper edge or upper point 54. Critically, the lower edge 51 and the upper point 54 are coupled to the back portion 30 whereas the left side edge 52 and right-side edge 53 are open and specifically not connected to the back portion 40. However, the lower edge 51, left side edge 52, and right-side edge 53 together define a lower pocket interior area that is open on the lateral sides but closed along the bottom such that a second disc golf disc 14 may be inserted from underside and cradled by the lower edge 51 within the lower pocket interior area. A flexible material extends between the stated edges.

With specific reference to FIG. 3, the left side edge 52 and right-side edge 53 of the lower pocket 50 may be angled upwardly at about 45° angles although having inwardly concave or arched configurations would also be suitable. Further, the lower edge 51 may be arched downwardly or may include multiple angled segments as shown. Similarly, the bottom edge of the upper pocket 40 may include a first bottom segment 43*a* that defines an imaginary horizontal axis and may have a pair of intermediate segments 43*b*, 43*c* extending upwardly and outwardly between the first bottom segment 43*a* and the first and second side edges 41, In other words, the bottom edge 43 may have a be beveled or even rounded configuration configured to receive the first disc golf disc 12 in a cradled or nested configuration. Stated another way, one or both pockets may include a single or multiple contiguous segments forming a generally downwardly rounded/arched configuration so as to cradle a disc golf disc. As shown in FIG. 3, each cradled disc extends upwardly outside of said upper pocket interior area and extends outside of said lower pocket interior area and laterally away from said left side edge and away from said right side edge simultaneously. Considering that a disc golf disc is cradled in a respective pocket in a manner that the respective disc still extends or protrudes outwardly, it follows geometrically that the respective pocket has (at most) an identical or, preferably) slightly smaller geometric volume than a geometric volume of the inserted disc. Also, it is appreciated that each pocket is constructed of a fabric material that would have a degree of resilience or flexibility to allow a disc to be received in a tight friction fit cradle. Stated still another way, it is appreciated that each pocket includes a dimension that is smaller than that of the received disc such that the disc must protrude from the open edges as described above.

Figure 5:
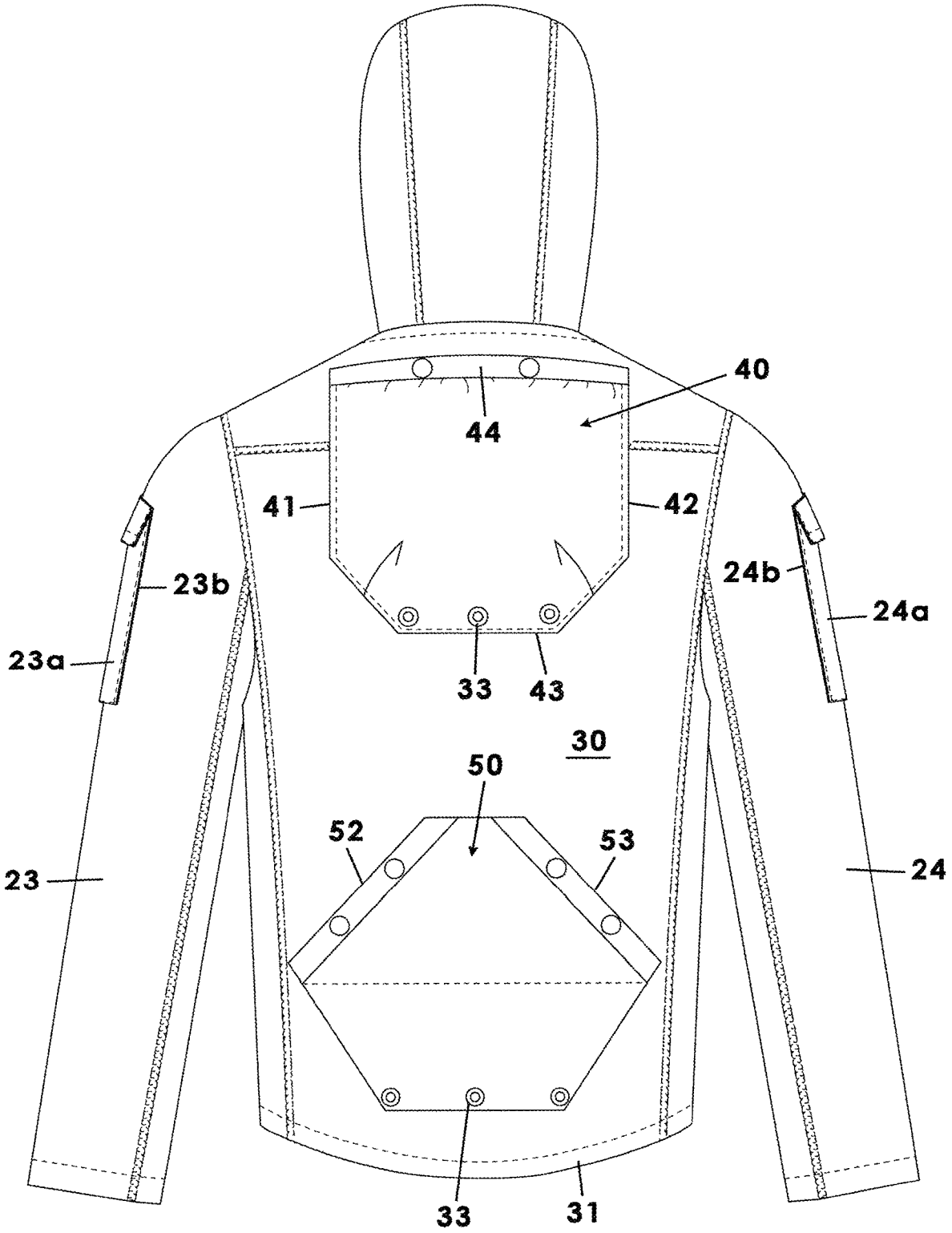
FIG. 5 is a rear view of the disc golf jacket as in FIG. 2, illustrated with first and second pockets configured in a larger size.

In addition, pockets of larger or smaller size are also possible, such as for use with golf discs of larger or smaller sizes. (FIG. 5). Also, the upper and lower pockets may be further anchored with fasteners such as rivets 33 or snaps. (FIG. 5).

In use, a user of the invention, e.g., a disc golf player, may preload the disc golf jacket 10 by inserting the first golf disc 12 and second golf disc 14 into the upper pocket 30 and lower pocket 40 before donning the jacket or after donning the jacket 10. In either case, the disc golf jacket 10 may be worn while the player performs routine non-game activities such as driving, walking, bicycling, or even going to school prior to gameplay. Then, the player is ready to play the game of disc golf whenever desired. Specifically, when ready to play, the player may extract the first golf this 12 from the upper pocket 40 over the shoulder in an action similar to pulling a.m. the arrow from the archery quiver. In addition, if access to the second golf disc 14 is desired, the user may extract it laterally from the lower pocket 50 in the lateral or sideways action as described above.

It is understood that while certain forms of this invention have been illustrated and described, it is not limited thereto except insofar as such limitations are included in the following claims and allowable functional equivalents thereof.

The invention claimed is:

1. A disc golf jacket for wear by a disc golf player, comprising:

a front torso portion extending upwardly between a front waist section and a neck section that is configured to cover the front torso of the player;

a right sleeve and a left sleeve coupled to said front torso portion proximate the neck section and configured to cover arms of the disc golf player;

a back portion extending upwardly from a rear waist section to said neck section, said back portion being coupled to said front torso portion along a top edge extending laterally away from said neck section;

an upper pocket having at least a first side edge, a second side edge opposite said first side edge, and a bottom edge that is closed extending between said first and second side edges and which, together, are coupled to said back portion via stitching so as to define an upper pocket interior area, said upper pocket including a top edge extending between upper ends of said first and second side edges, respectively, having a downwardly arched configuration and that is open and in communication with said upper pocket interior area such that said upper pocket is configured to receive a first disc golf disc via said top edge and to operatively cradle a first disc golf disc in a top-loaded configuration such that a portion of said first disc golf disc extends and protrudes outside of upwardly outside of said upper pocket interior area;

a lower pocket including at least a lower edge coupled to said back portion, a left side edge having a proximal end coupled to a first end of said lower edge, and a right side edge having a proximal end coupled to a second end of said lower edge, said left side edge and said right side edge extending away from said lower edge at angles that converge upwardly toward one another until meeting one another at an upper edge, said left side edge and said right side edge being open and unconnected to said back portion such that said lower pocket defines a lower pocket interior area that is configured to receive a second disc golf disc via said left or right side edge and to cradle said second disc golf disc in a side-loaded manner such that a portion of said second disc golf disc extends and protrudes outside of said lower pocket interior area;

wherein:

said left side edge and said right side edge of said lower pocket each has a downwardly arched configuration; and said left side edge and said right side edge extend upwardly at converging 45° angles.

2. The disc golf jacket as in claim 1, further comprising:

a collar integrally coupled to said front torso portion and said back portion and positioned to surround said neck section so as to protect a neck region of the player from weather events;

a left side portion extending upwardly between the waist sections of the front and back portions, respectively, and the left sleeve, said left portion being connected to said front and rear portions, respectively; and a right-side portion extending upwardly between the waist sections of the front and back portions, respectively, and the right sleeve, said right portion being connected to said front and rear portions, respectively.

3. The disc golf jacket as in claim 2, said front torso portion having a zipper separating said front torso portion into left and right sections and that is operable to couple or uncouple the left and right sections, respectively.

4. The disc golf jacket as in claim 1, wherein:

said upper pocket is positioned adjacent said neck section;

said lower pocket is positioned adjacent said waist section of said back portion; and said upper pocket and said lower pocket are positioned along a common vertical axis that extends between said waist section of said back portion and said neck section.

5. The disc golf jacket as in claim 1, wherein said left sleeve and said right sleeve each include a sleeve pocket defining a sleeve pocket chamber and a pocket sleeve opening in communication with said pocket sleeve chamber, each said sleeve pocket including a sleeve zipper that is operable to move between an open configuration giving access to said sleeve pocket chamber and a closed configuration blocking access to said sleeve pocket chamber.

6. The disc golf jacket as in claim 5, wherein said front torso portion includes a pair of front pockets each defining a front pocket chamber and a front pocket opening in communication with said front pocket chamber.

7. The disc golf jacket as in claim 1, wherein said bottom edge of said upper pocket includes a first bottom segment and a pair of intermediate segments extending upwardly and outwardly between opposed ends of the first bottom segment and said first and second side edges, respectively, so as to hold the first disc golf disc in the cradled configuration extending outside of said top edge of said upper pocket.

* * * * *